US009711084B2

(12) United States Patent
Uetake

(10) Patent No.: US 9,711,084 B2
(45) Date of Patent: Jul. 18, 2017

(54) PIXEL CIRCUIT WITH LARGE AND SMALL OLED ELEMENTS CONNECTED TO A SINGLE DRIVING TRANSISTOR WHEREIN THE LARGE OLED ELEMENT IS FURTHER CONTROLLED BY A MEMORY CIRCUIT WITHIN THE PIXEL

(71) Applicant: Japan Display Inc., Tokyo (JP)

(72) Inventor: Naoki Uetake, Tokyo (JP)

(73) Assignee: Japan Display Inc., Tokyo (JP)

( * ) Notice: Subject to any disclaimer, the term of this patent is extended or adjusted under 35 U.S.C. 154(b) by 65 days.

(21) Appl. No.: 14/552,519

(22) Filed: Nov. 25, 2014

(65) Prior Publication Data

US 2015/0145906 A1 May 28, 2015

(30) Foreign Application Priority Data

Nov. 26, 2013 (JP) ..... 2013-243783

(51) Int. Cl.
*G09G 3/32* (2016.01)
*G09G 3/20* (2006.01)
*G09G 3/3233* (2016.01)

(52) U.S. Cl.
CPC ..... *G09G 3/3233* (2013.01); *G09G 3/207* (2013.01); *G09G 3/2074* (2013.01); *G09G 2300/0452* (2013.01); *G09G 2300/0842* (2013.01)

(58) Field of Classification Search
CPC ..... G09G 3/30–3/3291; G09G 2300/0443; G09G 3/2074
See application file for complete search history.

(56) References Cited

U.S. PATENT DOCUMENTS

2002/0167477 A1* 11/2002 Tsutsui ..... G09G 3/3648 345/89
2003/0030601 A1* 2/2003 Komiya ..... G09G 3/2074 345/76
2003/0222840 A1* 12/2003 Koga ..... G09G 3/3696 345/89
2004/0150352 A1 8/2004 Koide et al.
2008/0042942 A1* 2/2008 Takahashi ..... G09G 3/207 345/77

(Continued)

FOREIGN PATENT DOCUMENTS

JP 2004-226673 A 8/2004
JP 2005-148306 A 6/2005

*Primary Examiner* — Chanh Nguyen
*Assistant Examiner* — Navin Lingaraju
(74) *Attorney, Agent, or Firm* — Typha IP LLC

(57) ABSTRACT

An organic EL display device includes a first pixel circuit for displaying a first color. The first pixel circuit includes a large light emitting element, a small light emitting element, and a current control circuit that controls whether a current is supplied to the small light emitting element and the large light emitting element or not respectively, and the amount of the current to be supplied to at least one of the small light emitting element and the large light emitting element, according to a tone to be displayed by the first pixel circuit. The current control circuit supplies the current to the small light emitting element if the tone is equal to or smaller than a threshold value, and supplies the current to at least the large light emitting element if the tone is larger than the threshold value.

7 Claims, 14 Drawing Sheets

(56) References Cited

U.S. PATENT DOCUMENTS

| | | | | |
|---|---|---|---|---|
| 2008/0062096 | A1* | 3/2008 | Yamashita | G09G 3/2074 345/82 |
| 2008/0197784 | A1* | 8/2008 | Benzarti | G09G 3/3233 315/169.3 |
| 2008/0225206 | A1* | 9/2008 | Satou | H01L 27/3211 349/68 |
| 2009/0128458 | A1* | 5/2009 | Kim | G09G 3/3233 345/76 |
| 2009/0128473 | A1* | 5/2009 | Yamashita | G09G 3/2074 345/89 |
| 2010/0109992 | A1* | 5/2010 | Sumi | G09G 3/3648 345/89 |
| 2011/0273493 | A1* | 11/2011 | Yoshiga | G09G 3/3607 345/694 |
| 2014/0354704 | A1* | 12/2014 | Pak | G09G 3/3291 345/690 |

* cited by examiner

PIXEL CIRCUIT WITH LARGE AND SMALL OLED ELEMENTS CONNECTED TO A SINGLE DRIVING TRANSISTOR WHEREIN THE LARGE OLED ELEMENT IS FURTHER CONTROLLED BY A MEMORY CIRCUIT WITHIN THE PIXEL

CROSS-REFERENCE TO RELATED APPLICATION

The present application claims priority from Japanese application JP2013-243783 filed on Nov. 26, 2013, the content of which is hereby incorporated by reference into this application.

BACKGROUND OF THE INVENTION

1. Field of the Invention

The present invention relates to an organic EL display device.

2. Description of the Related Art

In recent years, organic EL display devices have been increasingly developed. Moreover, an organic EL display device for representing a multiple tone to each pixel of the organic EL display device, and an organic EL display device for realizing a full-color display are becoming popular.

JP2005-148306A discloses, in order to represent multiple tone for each pixel displayed by the organic EL display device, controlling the magnitude of current flowing through the light-emitting elements included in each pixel with the use of a current programming system, and displaying the tone in a pixel circuit using an area coverage tone method if the tone is equal to or lower than a given tone level, and displaying the tone in a pixel circuit using a current programming system if the tone is higher than the given tone level.

JP2004-226673A discloses, in order to prevent a change in color balance due to changes in current density, expressing the tone with use of a pulse width modulation control or an area coverage tone control.

When a current flowing in a light emitting element is reduced for the purpose of expressing a low tone (brightness), a density of the current flowing in the light emitting element is reduced. In the organic EL (electro-luminescence) light emitting element, if the current density drops below a certain level, the brightness control becomes difficult.

SUMMARY OF THE INVENTION

The present invention has been made in view of the above problems, and therefore an object of the present invention is to more precisely express a brightness corresponding to the tone of a pixel if the tone to be expressed by the pixel is low.

An outline of typical features of the invention disclosed in the present application will be described in brief as follows.

(1) An organic EL display device including: a first pixel circuit for displaying a first color, the first pixel circuit including: a large light emitting element; a small light emitting element smaller in a light emitting area than the large light emitting element; and a current control circuit that controls whether a current is supplied to the small light emitting element and the large light emitting element or not respectively, and the amount of the current to be supplied to the small light emitting element or the large light emitting element to which the current is supplied, according to a tone to be displayed by the first pixel circuit, in which the current control circuit included in the first pixel circuit supplies the current to the small light emitting element if the tone to be displayed by the first pixel circuit is equal to or smaller than a threshold value, and supplies the current to at least the large light emitting element if the tone to be displayed by the first pixel circuit is larger than the threshold value.

(2) The organic EL display device according to the item (1) in which the current control circuit included in the first pixel circuit supplies the current to the large light emitting element so that the amount of current supplied to the large light emitting element simply monotonically increases according to an increase in a tone if the tone to be displayed by the first pixel circuit is larger than the threshold value.

(3) The organic EL display device according to the item (1) or (2), in which the current control circuit includes a drive transistor having a source and a drain, and the drive transistor regulates the amount of the current to be supplied to at least one of the small light emitting element and the large light emitting element to which the current is supplied, according to the tone to be displayed by the first pixel circuit.

(4) The organic EL display device according to the item (3), in which one end of the large light emitting element is connected to one of the source and the drain of the drive transistor through a switch.

(5) The organic EL display device according to any one of the items (1) to (4) further including: a second pixel circuit for displaying a second color different from the first color, the second pixel circuit including: a first light emitting element; and a current regulator circuit for regulating the amount of current to be supplied to the one light emitting element.

According to the present invention, if the tone to be expressed by the pixel is low, the brightness corresponding to the tone of the pixel can be more precisely expressed.

DETAILED DESCRIPTION OF THE INVENTION

Figure 1:
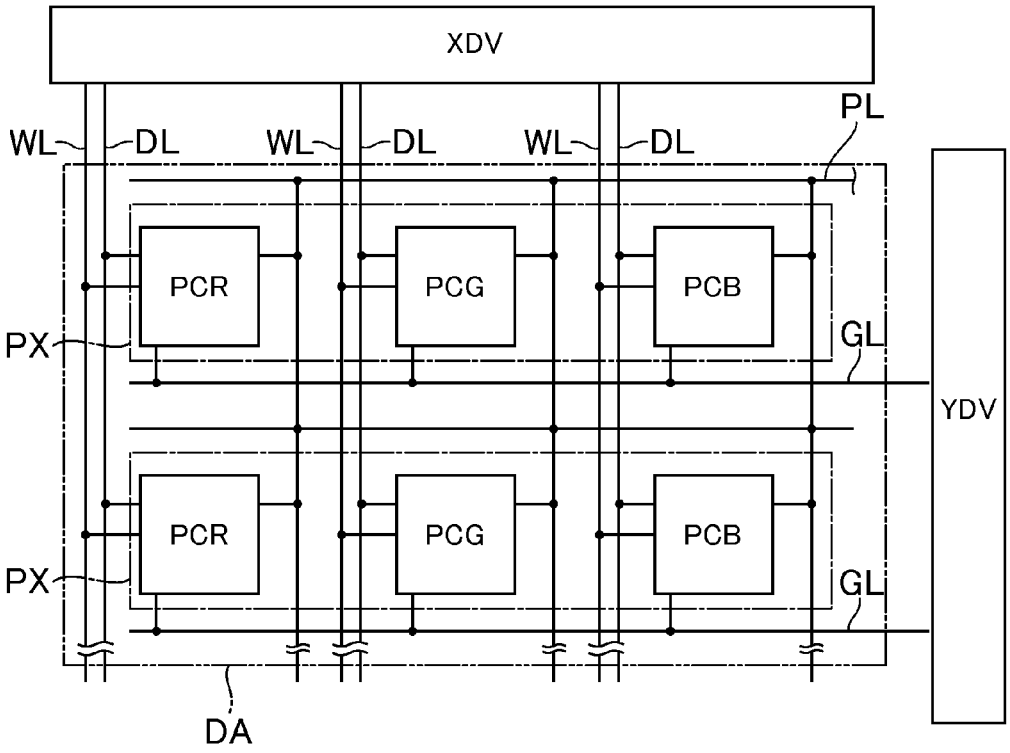
FIG. 1 is a circuit diagram illustrating an example of a configuration of an organic EL display device according to an embodiment of the present invention.

Hereinafter, embodiments of the present invention will be described with reference to the accompanying drawings. Parts having the same function in components are denoted by identical reference characters, and their description will be omitted. Hereinafter, the organic EL display device in which a white organic EL element is combined with a color filter will be described.

An organic EL display device according to an embodiment of the present invention includes an array substrate having a display area DA and a peripheral area, an integrated circuit package arranged in the peripheral area of the array substrate, a flexible substrate connected to the peripheral area, and a color filter substrate that faces the array substrate, and includes a color filter CF. The peripheral area on the array substrate surrounds the display area DA.

FIG. 1 is a circuit diagram illustrating an example of a configuration of an organic EL display device according to an embodiment of the present invention. Plural pixels PX are arranged in a matrix within a display area DA on an array substrate. In FIG. 1, only two pixels PX of 1×2 are illustrated, but a large number of pixels PX such as 1280×720 are arranged in fact. Each of the pixels PX includes a red pixel circuit PCR, a green pixel circuit PCG, and a blue pixel circuit PCB. The red pixel circuit PCR, the green pixel circuit PCG, and the blue pixel circuit PCB are circuits for displaying a red sub-pixel PR, a green sub-pixel PG, and a blue sub-pixel PB, respectively, and in an example illustrated in FIG. 1, the red pixel circuit PCR, the green pixel circuit PCG, and the blue pixel circuit PCB are arrayed in a horizontal direction.

One data line DL and one control line WL are provided in correspondence with each column of the pixel circuits PCR, PCG, and PCB. The number of data line DL and the number of control line WL are each obtained by multiplying the number of columns of pixels PX by the number of sub-pixels PR, PG, and PB (3 in the example of FIG. 1) per pixel PX. The plural data lines DL extend side by side in a longitudinal direction within the display area DA, and one ends of those data lines DL are connected to a data line driver circuit XDV. Also, the plural control lines WL also extend side by side in the longitudinal direction within the display area DA, and one ends of those control lines WL are connected to the data line driver circuit XDV.

Video data is input to the data line driver circuit XDV. The data line driver circuit XDV generates video signals and control signals corresponding to tones of the sub-pixels PR, PG, and PB included in the video data, and outputs the video signals and the control signals to the data lines DL and the control lines WL respectively.

Also, one scanning line GL is provided in correspondence with each row of the pixel circuits PCR, PCG, and PCB. The number of scanning lines GL is the number of rows of the pixels PX. The plural scanning lines GL extend side by side in a lateral direction within the display area DA, and one ends of the scanning lines GL are connected to a scanning line driver circuit YDV. Also, each of the pixel circuits PCR, PCG, and PCB is connected with a power supply line PL for supplying a supply voltage.

Figure 2:
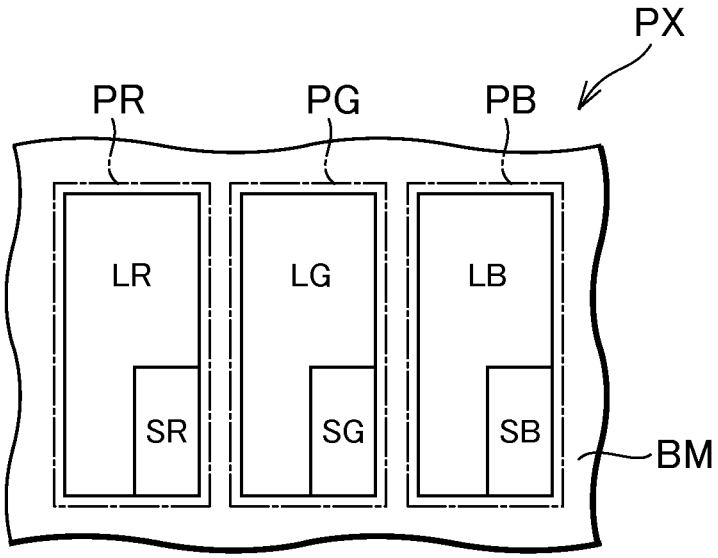
FIG. 2 is a diagram illustrating one example of a pixel.

FIG. 2 is a diagram illustrating an example of a certain pixel PX. FIG. 2 is a diagram illustrating a layout of the pixel PX within the display area DA of the organic EL display device when viewed from the outside. Each of the pixels PX includes the red sub-pixel PR, the green sub-pixel PG, and the blue sub-pixel PB. The sub-pixels PR, PG, and PB include large light emitting areas LR, LG, LB, and small light emitting areas SR, SG, SB, respectively. On the color filter substrate are provided the color filters CF of red, green, and blue for the sub-pixels PR, PG, and PB, and a black matrix BM that blocks light is disposed in an area corresponding to spaces between the respective sub-pixels PR, PG, and PB. The large light emitting areas LR, LG, and LB are larger than the small light emitting areas SR, SG, and SB. For facilitation of description, any one of the large light emitting areas LR, LG, and LB is called "large light emitting area LA", and any one of the small light emitting areas SR, SG, and SB is called "small light emitting area SA". It is preferable that a size of the small light emitting area SA is ⅕ to ¼ of a size of the large light emitting area LA.

Figure 3:
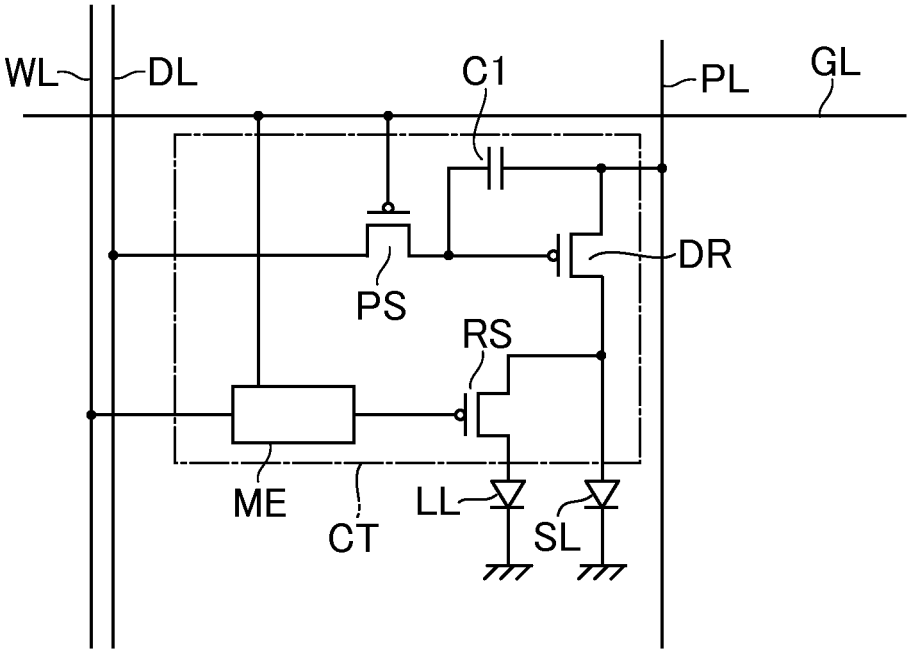
FIG. 3 is a circuit diagram illustrating an example of a pixel circuit.

FIG. 3 is a circuit diagram illustrating an example of the pixel circuits PCR, PCG, and PCB. Each of the pixel circuits PCR, PCG, and PCB includes a large light emitting element LL, a small light emitting element SL, and a current control circuit CT.

The current control circuit CT controls whether a current is allowed to flow into the large light emitting element LL and the small light emitting element SL or not respectively, on the basis of the video signal and the control signal input from the data line DL and the control line WL. The current control circuit CT also controls the amount of current to be supplied to at least one of the large light emitting element LL and the small light emitting element SL when the current is supplied to at least one of those elements, on the basis of the video signal and the control signal. The current control circuit CT includes a drive transistor DR, an area select switch RS, a storage capacitor C1, a pixel switch PS, and a memory circuit ME. The large light emitting element LL outputs the lights of the large light emitting areas LR, LG, and LB, and the small light emitting element SL outputs the lights of the small light emitting areas SR, SG, and SB. Each of the large light emitting element LL and the small light emitting element SL is an organic EL element of the type which emits the light of white (all of primary colors of red, green, blue).

The drive transistor DR regulates the amount of current to be supplied to at least one of the large light emitting element LL and the small light emitting element SL to which the current is to be supplied, according to the video signal. The drive transistor DR is a p-channel type thin film transistor, and has a source electrode connected to the power supply line PL, and a drain electrode connected to an anode of the small light emitting element SL. Also, the drain electrode of the drive transistor DR is also connected to the large light emitting element LL through the area select switch RS. The area select switch RS is configured to select whether the current is allowed to flow into the large light emitting element LL, or not. Also, the area select switch RS is a thin film transistor, and the gate electrode is connected to the memory circuit ME. The thin film transistor such as the drive transistor DR may be configured by an n-channel type thin film transistor.

In this example, instead of the drive transistor DR being connected directly to the small light emitting element SL, the small light emitting element SL may be connected to the drain electrode of the drive transistor DR through a select switch different from the area select switch RS. In this case, the select switch is also connected to the memory circuit ME.

The pixel switch PS is configured by a thin film transistor, and turns on in a horizontal period where a scanning signal is supplied from the scanning line GL. When the pixel switch PS turns on, the pixel switch PS supplies the video signal or the like supplied from the data line DL to the storage capacitor C1. Also, the storage capacitor C1 stores a potential difference between the video signal supplied from the data line DL and the potential of the power supply line PL, and controls the amount of current allowed to flow by the drive transistor DR due to the potential difference. The memory circuit ME stores a potential to be supplied to the control line WL when the scanning signal is supplied from the scanning line GL. The memory circuit ME supplies the potential to the gate electrode of the area select switch RS on the basis of the potential until the pixel circuits PCR, PCG, and PCB are scanned in a subsequent frame (after a vertical scanning period elapses) to control the on/off operation of the area select switch RS. If the select switch for the small light emitting element SL is provided, for example, the memory circuit ME may supply a potential obtained by processing the potential to be sent to the area select switch RS by a NOT logic circuit. Alternatively, the memory circuit ME may acquire a signal for controlling the select switch from the data line driver circuit XDV with the provision of an additional second control line, store the potential of the signal, separately, and supply the stored potential to the gate electrode of the select switch.

Figure 4:
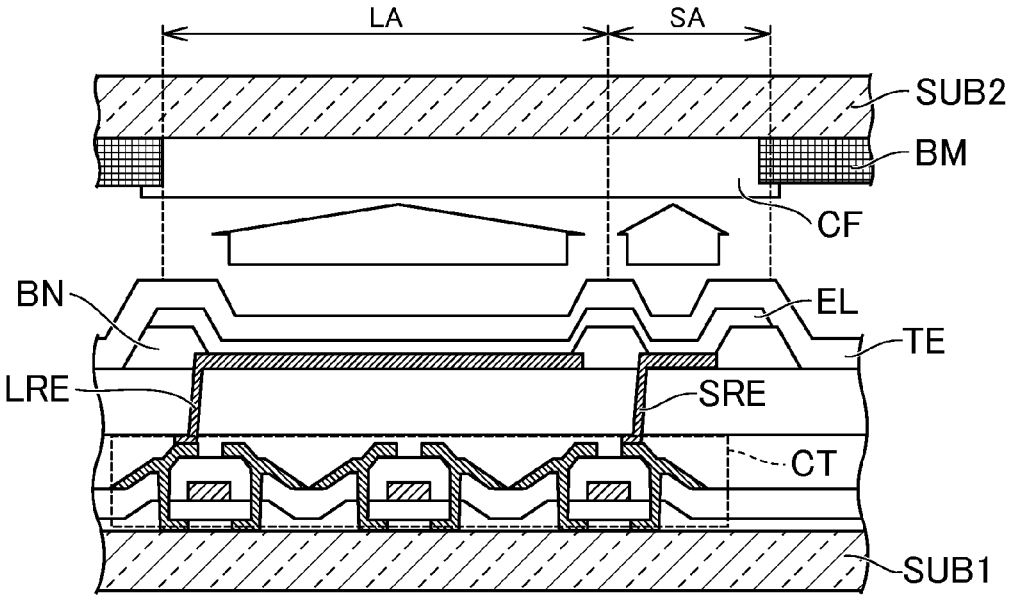
FIG. 4 is a diagram illustrating an example of a cross-section of a sub-pixel.

FIG. 4 is a diagram illustrating an example of one cross-section of the sub-pixels PR, PG, and PB. The array substrate includes a glass substrate SUB1, the current control circuit CT formed on the glass substrate SUB1, a flattening film FL, a reflection electrode LRE of the large light emitting element LL, a reflection electrode SRE of the small light emitting element SL, a bank BN, an organic light emitting layer EL, and a transparent electrode TE. The reflection electrode LRE, and portions of the organic light emitting layer EL and the transparent electrode TE above the reflection electrode LRE correspond to the large light emitting element LL. The reflection electrode SRE, and portions of the organic light emitting layer EL and the transparent electrode TE above the reflection electrode SRE correspond to the small light emitting element SL. Also, the color filter substrate includes a glass substrate SUB2, the color filter CF, and the black matrix BM.

As is apparent from FIGS. 4 and 2, the black matrix BM is not formed between the large light emitting area LA and the small light emitting area SA. Also, in the organic light emitting layer EL, an area corresponding to the large light emitting element LL is connected to an area corresponding to the small light emitting element SL. Even if the organic light emitting layer EL is not cut off between the large light emitting element LL and the small light emitting element SL, if a voltage is applied to only the reflection electrode SRE of the small light emitting element SL, only the small light emitting area SA emits light. If a voltage is applied to only the reflection electrode LRE of the large light emitting element LL, only the large light emitting area LA emits light. With the above operation, a rate of the area that emits the light in the respective sub-pixels PR, PG, and PB can increase.

Subsequently, a description will be given of a method of allowing the sub-pixels PR, PG, and PB to express the brightness corresponding to the tone indicated by image data with the use of the small light emitting element SL and the large light emitting element LL. The tones of the sub-pixels PR, PG, and PB are input to the data line driver circuit XDV as video data. The data line driver circuit XDV determines whether only the small light emitting element SL or the large light emitting element LL emits light according to the tone for each of the sub-pixels PR, PG, and PB. The data line driver circuit XDV determines that only the small light emitting element SL emits the light if the tone is equal to or smaller than a threshold value D1, and determines that both of the small light emitting element SL and the large light emitting element LL emit light if the tone exceeds the threshold value D1. If a select switch is present between the drive transistor DR and the small light emitting element SL, the data line driver circuit XDV allows the current to flow in only the large light emitting element LL if the tone exceeds the threshold value D1. Further, if the tone exceeds another threshold value D2, the drive transistor DR may allow the current to flow into both of the large light emitting element LL and the small light emitting element SL.

The data line driver circuit XDV generates a potential of the video signal corresponding to the determination result and the tone, and a control signal for controlling whether the current is allowed to flow in the large light emitting element LL, or not. The data line driver circuit XDV supplies the video signal and the control signal thus generated to the data line DL connected to the pixel circuits PCR, PCG, and PCB at timing when the pixel circuits PCR, PCG, and PCB are scanned with the scanning line driver circuit YDV. The current control circuit CT included in each of the pixel circuits PCR, PCG, and PCB stores the video signal and the control signal thus supplied, and controls the amount of current flowing in the small light emitting element SL and the large light emitting element LL. More specifically, the current control circuit CT turns off the area select switch RS if the tone is equal to or smaller than the threshold value D1, and turns on the area select switch RS if the tone exceeds the threshold value D, according to the control signal.

Figure 5:
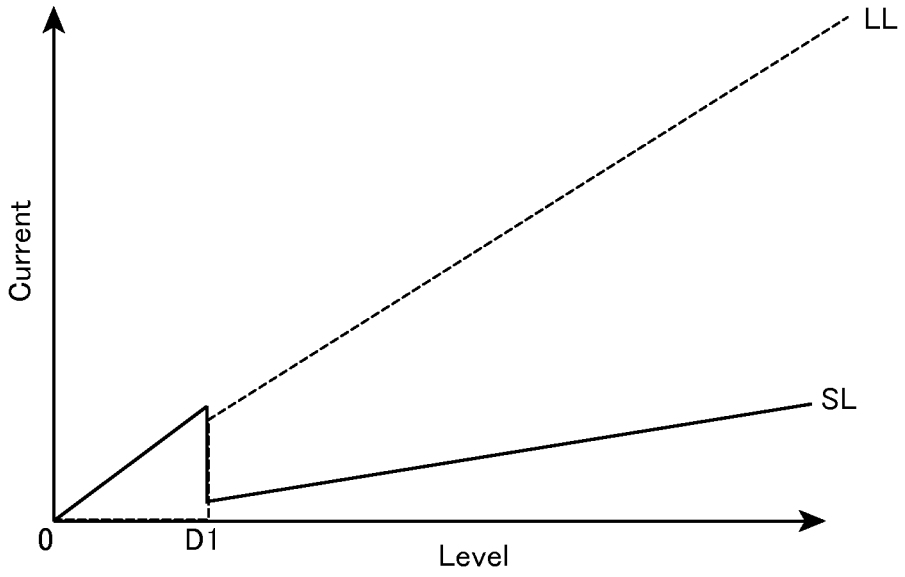
FIG. 5 is a diagram illustrating relationships between the tone and the amount of current flowing in a small light emitting element and a large light emitting element.

FIG. 5 is a diagram illustrating relationships between the tone and the amount of current flowing in the small light emitting element SL and the large light emitting element LL. In a graph illustrated in FIG. 5, a solid line represents a relationship between the amount of current flowing in the large light emitting element LL and the tone, and a dashed line represents a relationship between the amount of current flowing in the small light emitting element SL and the tone. If the tone is equal to or smaller than the threshold value D1, the amount of current flowing in the small light emitting element SL simply monotonically increases according to an increase in the tone, but no current flows in the large light emitting element LL. Also, if the tone exceeds the threshold value D1, the current flows into both of the small light emitting element SL and the large light emitting element LL, and the amount of current flowing into each of the large light emitting element LL and the small light emitting element SL simply monotonically increases as the tone increases. In a subsequent tone of the threshold value D1, the tone of current flowing in the small light emitting element SL decreases below the tone of the threshold value D1 while the current flowing into the large light emitting element LL occurs.

Figure 6:
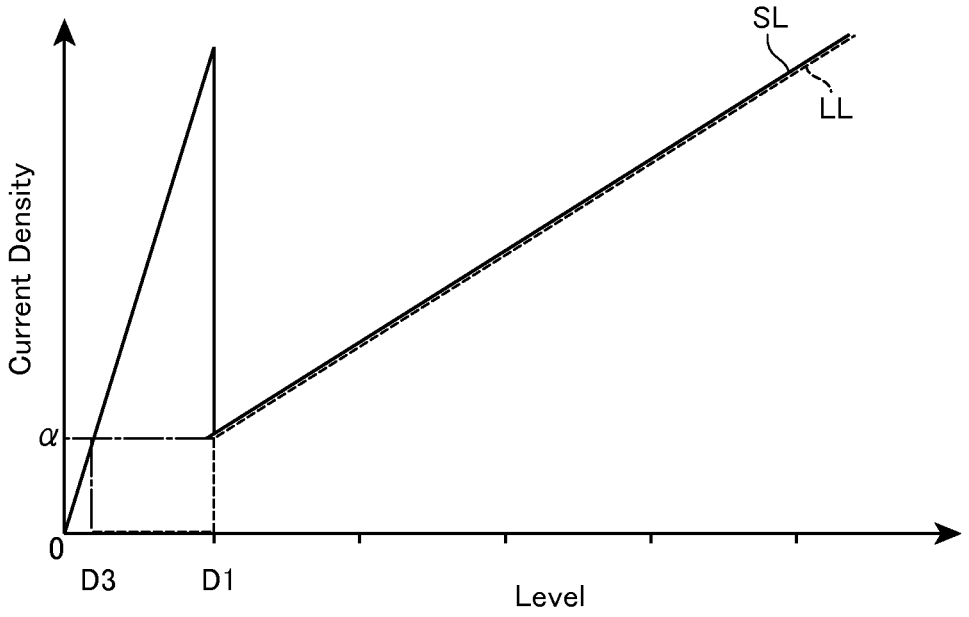
FIG. 6 is a diagram illustrating an example of relationships between the tone and current densities of current flowing in a small light emitting element and a large light emitting element.

When the current is thus allowed to flow, a reduction in the current density can be suppressed. FIG. 6 is a diagram illustrating relationships between the tone and current densities of current flowing in the small light emitting element SL and the large light emitting element LL. If the current is allowed to flow into the large light emitting element LL with the tone equal to or smaller than the threshold value D1, the current density simply monotonically increases from 0 to α while the tone increases from a lowest tone to the threshold value D1. For that reason, the current density becomes equal to or smaller than α with the tone equal to or smaller than the threshold value D1. On the other hand, if the current is allowed to flow into only the small light emitting element SL with the tone equal to or smaller than the threshold value D1, and no current is allowed to flow into the large light emitting element LL, the current density of current flowing in the small light emitting element SL is about ((area of small light emitting element SL+area of large light emitting element LL)/area of small light emitting element SL) times as compared with a case in which the current is allowed to flow into the large light emitting element LL. Therefore, a reduction in the current density when the tone is equal to or smaller than the threshold value D1 is suppressed. As a result, a tone D3 where the current density is equal to or smaller than α is reduced below D1.

Figure 7:
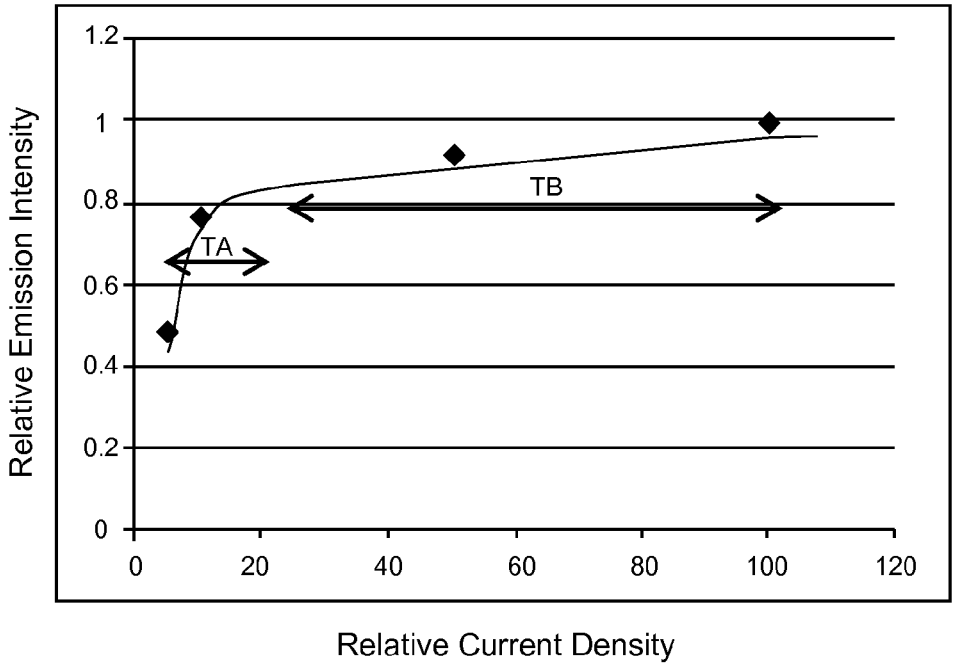
FIG. 7 is a diagram illustrating an example of a relationship between the intensity of a blue component of light output by the light emitting element, and a relative current density.

FIG. 7 is a diagram illustrating a relationship between the intensity of a blue component of the light output by the organic EL element, and a relative current density. FIG. 7 illustrates a ratio of the relative current density which is 100 at the maximum tone, and a ratio of the relative light emitting intensity when the light emitting intensity of the red component is 1. In a range TB where the relative current density exceeds a certain intensity, a change in the relative light emitting intensity caused by a change in the current density is small and linear as compared with a range TA in which the relative current density is smaller than the range TB. Therefore, the brightness adjustment by correction or the like is easy. On the other, in the range TA, the relative light emitting intensity nonlinearly largely changes with the change in the current density. In this range TA, a change in the light emitting intensity per se becomes steeper. For that reason, the adjustment of brightness by correction is very difficult. In this embodiment, the current density can fall within the range TB in which the adjustment of brightness is easy even at a lower tone, and therefore, a precise brightness corresponding to the tone can be output.

Figure 8:
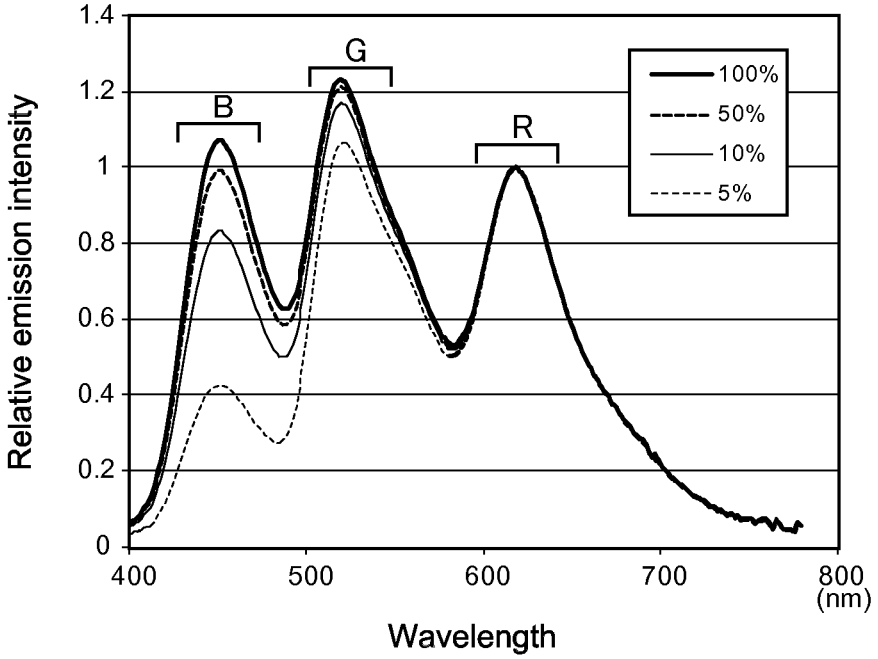
FIG. 8 is a diagram illustrating an example of a relationship between a light emission spectrum of a white light emitting element and the relative current density.

Also, the organic EL display device can express more precise color hue. FIG. 8 is a diagram illustrating an example of a relationship between the light emission spectrum of the white organic EL element and the relative current density. As is apparent from FIG. 8, the magnitude of a reduction in the relative light emitting intensity caused by a reduction in the relative current density is different depending on components of blue, green, and red. When the current density decreases, the light emitting intensity of a specific color component largely decreases as compared with the light emitting intensity of the other color components. For that reason, for example, if the current density becomes smaller, the light emitting color becomes yellowish. For that reason, the color hue of the light output by the light emitting element changes. In this embodiment, because the reduction in the current density is suppressed at the low tone, a change in the color hue can be also suppressed. The colors likely to be lowered in the relative light emitting intensity caused by the reduction in the current density are different depending on manufacturing methods of the organic EL element. The color components other than blue may change according to the current density depending on the type of the light emitting elements.

Figure 9:
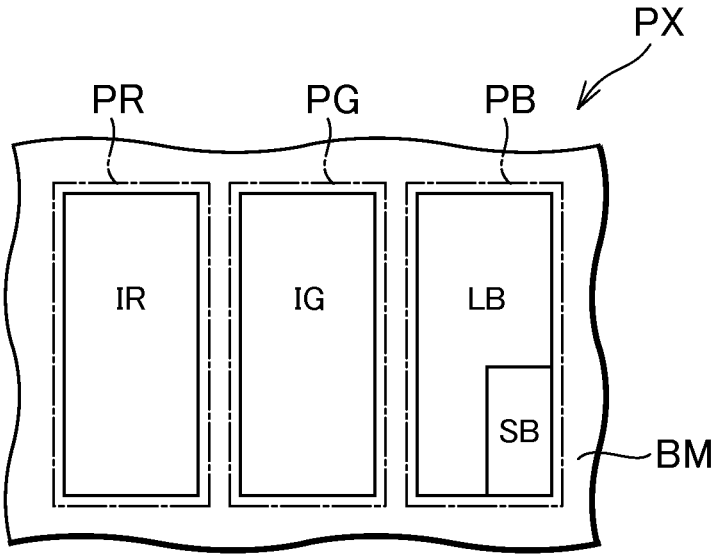
FIG. 9 is a diagram illustrating another example of the pixel.

A part of the sub-pixels PR, PG, and PB included in the pixels PX may be realized by a pixel circuit including the large light emitting element LL and the small light emitting element SL, and the remaining sub-pixel may be realized by a pixel circuit including one light emitting element IL. FIG. 9 is a diagram illustrating another example of the pixel PX. In the example of FIG. 8, the sub-pixels PR and PG of red and green are small in a reduction of the relative light emitting intensity caused by the reduction in the current density. In order to use this characteristic, the red sub-pixel PR and the green sub-pixel PG include only one light emitting areas IR, and IG, respectively, and are not divided into the large light emitting area LB and the small light emitting area SB, unlike the blue sub-pixel PB.

Figure 10:
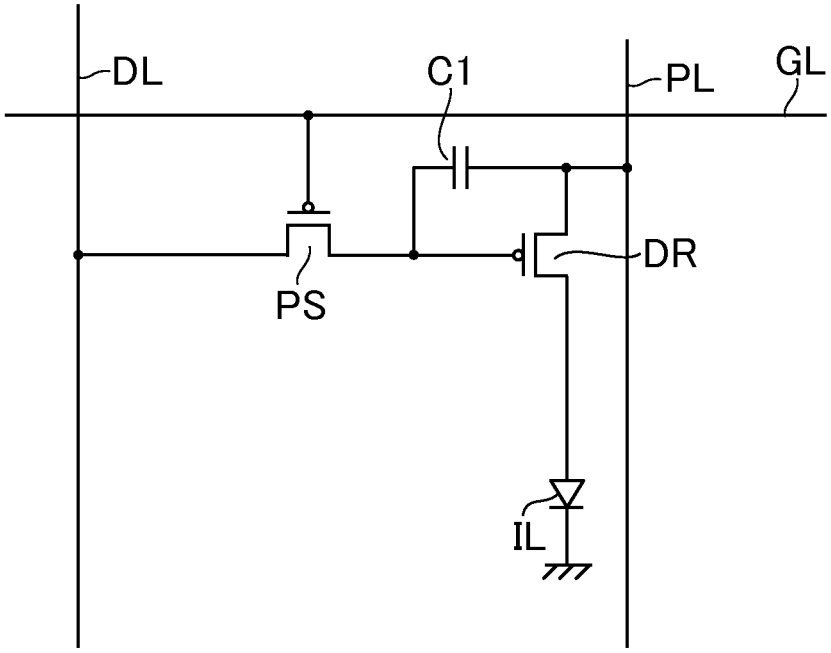
FIG. 10 is a diagram illustrating an example of a pixel circuit forming red and green sub-pixels illustrated in FIG. 9.

FIG. 10 is a diagram illustrating an example of the pixel circuits PCR and PCG forming red and green sub-pixels PR and PG illustrated in FIG. 9. The number of the light emitting elements IL provided in the pixel circuits PCR and PCG is one, and the light emitting element IL is connected to the drive transistor DR. The pixel circuits PCR and PCG do not include the area select switch RS and the memory circuit ME, and also does not require the control line WL.

Figure 11:
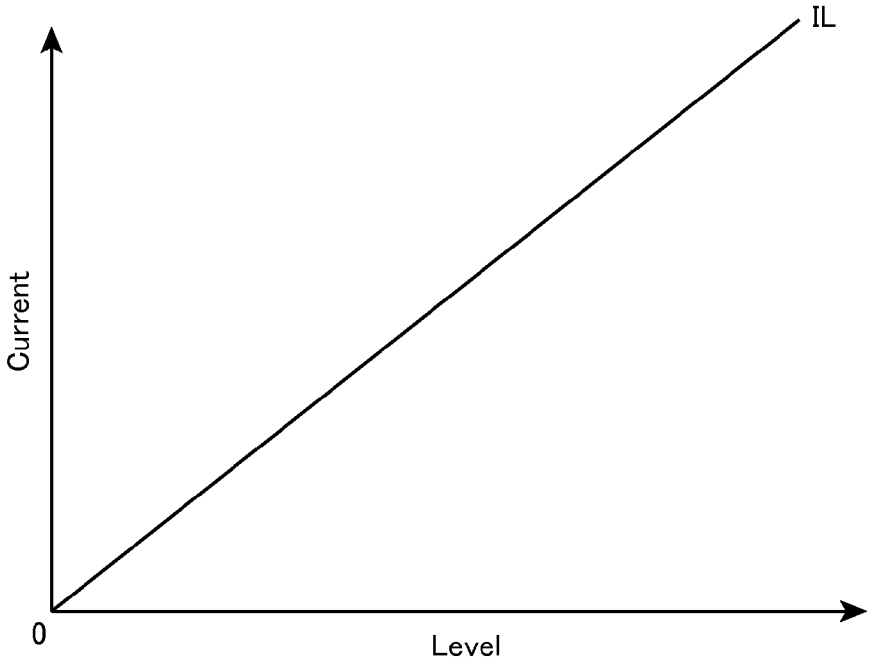
FIG. 11 is a diagram illustrating an example of a relationship between tone and a current flowing in a light emitting element included in a pixel circuit configuring red and green sub-pixels illustrated in FIG. 9.

FIG. 11 is a diagram illustrating an example of a relationship between the tone and the current flowing in the light emitting element IL included in the pixel circuits PCR and PCG configuring red and green sub-pixels PR and PG illustrated in FIG. 9. The amount of current that flows in the light emitting element IL simply monotonically increases as the tone increases. Therefore, in the red and green sub-pixels PR and PG, the relative light emitting intensity has a trend to be reduced, for example, at the tone lower than the threshold value D1, but the reduced amount is low as compared with the blue sub-pixel PB. If the video signal is corrected, for example, an influence of this reduction on the color hue can be restricted. Therefore, in the example of the pixel PX illustrated in FIG. 9, while the more precise color hue expression can be conducted, the number of wirings such as the control lines WL and the number of thin film transistors are reduced as compared with the example of FIG. 2, and the circuit configuration of the array substrate can be simplified.

The example in which each of the pixels PX is expressed by the three sub-pixels PR, PG, and PB has been described above. Alternatively, one pixel PX may be configured by four sub-pixels PR, PG, PB, and PW. Similarly, in this case, the brightness can be more precisely expressed with the use of the large light emitting element LL and the small light emitting element SL, and the more precise color hue can be expressed.

Figure 12:
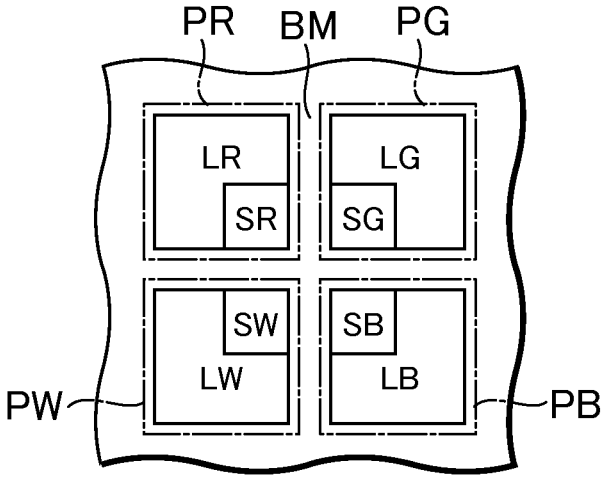
FIG. 12 is a diagram illustrating another example of the pixel.

FIG. 12 is a diagram illustrating another example of the pixels PX. Each of the pixels PX includes four sub-pixels PR, PG, PB, and PW. In an example of FIG. 13, the white sub-pixel PW includes a white large light emitting area LW, and a white small light emitting area SW. Also, the red sub-pixel PR includes a red large light emitting area LR, and a red small light emitting area SR, the green sub-pixel PG includes a green large light emitting area LG, and a green small light emitting area SG, and the blue sub-pixel PB includes a blue large light emitting area LB, and a blue small light emitting area SB. The white sub-pixel PW is expressed by a white pixel circuit PCW not shown. The configuration of the white pixel circuit PCW has the same configuration as that of the pixel circuits PCR, PCG, and PCB, and the white pixel circuit PCW controls a current flowing in the large light emitting element LL and the small light emitting element SL on the basis of the video signal and the control signal supplied from the data line driver circuit XDV.

In the white sub-pixel PW, because light that does not pass through the color filter CF is output, if a change in the color hue described in FIG. 8 occurs, a change in the color hue gets to a person who watches the organic EL display device as it is. In an example of FIG. 12, only the small light emitting element SL emits light in the white pixel circuit PCW when the brightness is low, thereby capable of directly suppressing the change in the color hue.

Figure 13:
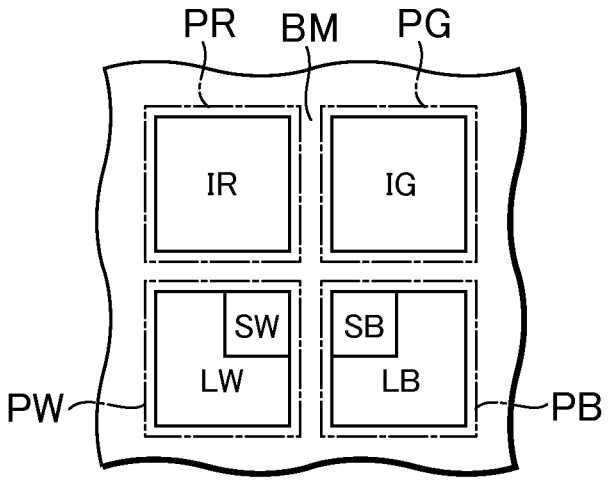
FIG. 13 is a diagram illustrating another example of the pixel.

FIG. 13 is a diagram illustrating another example of the pixels PX. In the example of FIG. 13, the white sub-pixel PW has the white large light emitting area LW, and the white small light emitting area SW, and the blue sub-pixel PB has the blue large light emitting area LB, and the blue small light emitting area SB. On the other hand, the red sub-pixel PR and the green sub-pixel PG include only one light emitting areas IR and IG, respectively. This is because a need to provide the small light emitting element SL for blue large in change in the relative light emitting intensity, and white likely to change in the color hue is high in the example of FIG. 8. With this configuration, the circuit can be simplified while more precisely expressing the brightness and the color hue of the pixel PX including the four sub-pixels PR, PG, PB, and PW.

Figure 14:
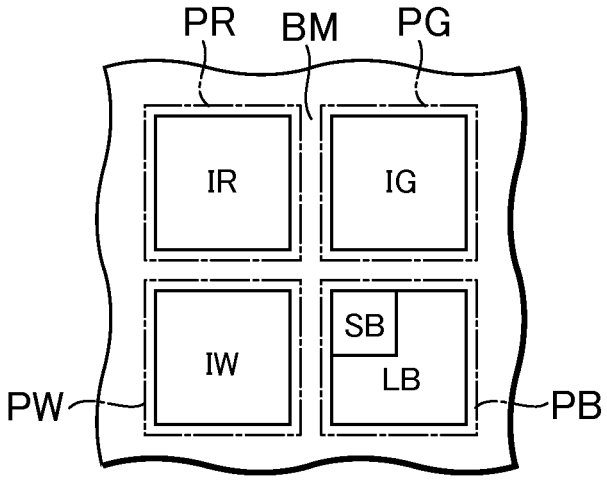
FIG. 14 is a diagram illustrating another example of the pixel.

FIG. 14 is a diagram illustrating another example of the pixel PX. In the example of FIG. 14, the blue sub-pixel PB includes the blue large light emitting area LB, and the blue small light emitting area SB. On the other hand, the white sub-pixel PW, the red sub-pixel PR, and the green sub-pixel PG include only one light emitting areas IW, IR, and IG, respectively. Then, the data line driver circuit XDV outputs the video signal that does not allow the white sub-pixel PW to emit the light toward the pixel circuit PCW at the tone smaller than the threshold value D1, and instead outputs the video signal to emit the light from the red, green, and blue sub-pixels PR, PG, and PB. With this configuration, the current that flows in the small light emitting element SL or the light emitting element IL included in the red, green, and blue sub-pixels PR, PG, and PB can be increased, and the expression of the brightness or the color hue can be controlled more precisely than the example of FIG. 13. Also, if the tone is lower than D1, the low power consumption that is an advantage obtained by using the sub-pixel PW is not obtained. However, because the effects of a reduction in the power consumption are small at the low tone, the low power consumption can be sufficiently performed as a whole.

While there have been described what are at present considered to be certain embodiments of the invention, it will be understood that various modifications may be made thereto, and it is intended that the appended claims cover all such modifications as fall within the true spirit and scope of the invention.

What is claimed is:

1. An organic EL display device comprising:

a first pixel having a first pixel circuit for displaying a first color;

a second pixel being adjacent to the first pixel and having a second pixel circuit for displaying a second color different from the first color;

the first pixel circuit including:

a large light emitting element;

a small light emitting element smaller in a light emitting area than the large light emitting element; and a current control circuit that controls whether a current is supplied to the small light emitting element and the large light emitting element or not respectively, and the amount of the current to be supplied to the small light emitting element or the large light emitting element to which the current is supplied, according to a tone to be displayed by the first pixel circuit, the second pixel circuit including:

only one light emitting element; and a current regulator circuit for regulating the amount of current to be supplied to the only one light emitting element, wherein the first pixel has a first light emitting area, the first light emitting area consists of a large light emitting area corresponding to the large light emitting element and a small light emitting area corresponding to the small light emitting element, the second pixel has a second light emitting area, the second light emitting area consists of only one light emitting area corresponding to the only one light emitting element, and wherein the current control circuit included in the first pixel circuit supplies the current to the small light emitting element if the tone to be displayed by the first pixel circuit is equal to or smaller than a threshold value, and supplies the current to at least the large light emitting element if the tone to be displayed by the first pixel circuit is larger than the threshold value, a drive transistor included in the current control circuit regulates the amount of the current to be supplied to the small light emitting element and the large light emitting element, the large light emitting element and the small light emitting element are electrically connected to one electrode of a source electrode and a drain electrode of the drive transistor in parallel through a switch, and the current control circuit includes the switch that is between the one electrode and the large light emitting element, the switch is controlled by a signal from a control line, and a gate of the switch is connected to a memory circuit which stores the signal, wherein the current control circuit includes the memory circuit and the memory circuit supplies the signal by processing using a NOT logic circuit.

2. The organic EL display device according to claim 1, wherein the current control circuit included in the first pixel circuit supplies the current to the large light emitting element so that the amount of current supplied to the large light emitting element simply monotonically increases according to an increase in a tone if the tone to be displayed by the first pixel circuit is larger than the threshold value.

3. The organic EL display device according to claim 1, wherein the drive transistor regulates the amount of the current to be supplied to the small light emitting element and the large light emitting element to which the current is supplied, according to the tone to be displayed by the first pixel circuit.

4. The organic EL display device according to claim 1, further comprising a pixel including a plurality of sub pixels, wherein the plurality of sub pixels include the first pixel and the second pixel.

5. The organic EL display device according to claim 1 wherein the current control circuit supplies the current to both the large light emitting element and the small light emitting element if the tone to be displayed by the first pixel circuit is larger than the threshold value.

6. The organic EL display device according to claim 5, wherein the current control circuit supplies a first current to the small light emitting element if the tone is equal to the threshold value and a second current to the small light emitting element if the tone is a subsequent level of the threshold value, and the first current is larger than the second current.

7. The organic EL display device according to claim 5, wherein the current control circuit supplies a first current to the small light emitting element if the tone is equal to the threshold value and a second current to the small light emitting element if the tone is a subsequent level of the threshold value, and a current density of the first current is larger than a current density of the second current.

* * * * *